United States Patent [19]

Wollenberg

[11] Patent Number: 4,624,681

[45] Date of Patent: Nov. 25, 1986

[54] DISPERSANT ADDITIVES FOR LUBRICATING OILS AND FUELS

[75] Inventor: Robert H. Wollenberg, San Rafael, Calif.

[73] Assignee: Chevron Research Company, San Francisco, Calif.

[21] Appl. No.: 835,130

[22] Filed: Feb. 28, 1986

Related U.S. Application Data

[62] Division of Ser. No. 643,217, Aug. 22, 1984, Pat. No. 4,584,117.

[51] Int. Cl.[4] ..... C10L 1/22

[52] U.S. Cl. ..... 44/63; 44/71; 252/51.5 A

[58] Field of Search ..... 44/63, 71; 252/51.5 A, 252/51.5 R; 260/463; 562/166; 548/545

[56] References Cited

U.S. PATENT DOCUMENTS

| | | | |
|---|---|---|---|
| 2,802,022 | 8/1957 | Grogzos et al. | 260/471 |
| 2,844,449 | 7/1958 | Dille et al. | 44/70 |
| 2,921,955 | 1/1960 | Newman et al. | 44/71 |
| 2,991,162 | 7/1961 | Malec | 44/58 |
| 3,216,936 | 11/1965 | LeSuer | 252/32.7 |
| 3,219,666 | 11/1965 | Norman et al. | 260/268 |
| 3,367,943 | 2/1968 | Miller et al. | 260/326.3 |
| 3,373,111 | 3/1968 | LeSuer et al. | 252/51.5 |
| 3,652,240 | 3/1972 | Dorn et al. | 44/66 |
| 4,460,381 | 7/1984 | Karol et al. | 44/63 |
| 4,482,464 | 11/1984 | Karol et al. | 252/51.5 A |
| 4,490,154 | 12/1984 | Sung et al. | 44/70 |
| 4,501,597 | 2/1985 | Karol et al. | 44/63 |

FOREIGN PATENT DOCUMENTS

| | | |
|---|---|---|
| 689705 | 4/1953 | United Kingdom . |

*Primary Examiner*—Jacqueline V. Howard

*Attorney, Agent, or Firm*—S. R. LaPaglia; R. C. Gaffney; G. F. Swiss

[57] ABSTRACT

Disclosed are additives which are useful as dispersants in lubricating oils, gasolines, marine crankcase oils and hydraulic oils. In particular, disclosed are additives prepared by first reacting a polyamine with a cyclic carbonate followed by reaction of this intermediate with an alkenyl or alkyl succinic anhydride.

19 Claims, No Drawings

DISPERSANT ADDITIVES FOR LUBRICATING OILS AND FUELS

This is a division of application Ser. No. 643,217, filed Aug. 22, 1984, now U.S. Pat. No. 4,584,117.

BACKGROUND OF THE INVENTION

1. Field of the Invention

This invention relates to additives which are useful as dispersants and detergents in lubricating oils. In particular, this invention is directed toward additives prepared by reacting a polyamine with a cyclic carbonate and then reacting the resulting intermediate with an alkenyl or alkyl succinic anhydride. The novel additives of this invention have been found to possess dispersancy and detergency properties when employed in a lubricating oil. These additives are also useful as detergents and dispersants in fuels.

2. Prior Art

Alkenyl or alkyl succinimides have been previously modified with alkylene oxides to produce poly(oxyalkylene)hydroxy derivatives thereof. These alkylene oxide treated succinimides are taught as additives for lubricating oils (see U.S. Pat. Nos. 3,373,111 and 3,367,943).

SUMMARY OF THE INVENTION

It has now been found that additives made by first reacting a polyamine with a cyclic carbonate followed by reaction of this intermediate with an alkenyl or alkyl succinic anhydride yield dispersants and detergents for use in fuels or oils. Accordingly, the present invention relates to a product prepared by the process which comprises (a) first contacting, at a temperature sufficient to cause reaction, a polyamine with a cyclic carbonate; and (b) contacting the product of (a) with an alkenyl or alkyl succinic anhydride at a temperature sufficient to cause reaction.

As noted above, the novel additives of this invention possess dispersancy and detergency properties when used in either lubricating oils or fuels. Thus, another aspect of this invention is a lubricating oil composition comprising a major amount of an oil of lubricating viscosity and an amount of an additive of this invention sufficient to provide dispersancy and detergency.

In still another aspect of this invention is a fuel composition comprising a major portion of a hydrocarbon boiling in a gasoline and diesel range and an amount of an additive of this invention sufficient to provide dispersancy and detergency.

DETAILED DESCRIPTION OF THE INVENTION

The additives of this invention are prepared by first reacting a polyamine with a cyclic carbonate. The reaction is conducted at a temperature sufficient to cause reaction of the cyclic carbonate with the polyamine. In particular, reaction temperatures of from about 0° C. to about 250° C. are preferred with temperatures of from about 100° C. to 200° C. being most preferred.

The reaction may be conducted neat—that is, both the polyamine and the carbonate are combined in the proper ratio, either alone or in the presence of a catalyst, such as an acidic, basic or Lewis acid catalyst, and then stirred at the reaction temperature. Examples of suitable catalysts include, for instance, boron trifluoride, alkane sulfonic acid, alkali or alkaline carbonate.

Alternatively, the reaction may be conducted in a diluent. For example, the reactants may be combined in a solvent such as toluene, xylene, oil or the like, and then stirred at the reaction temperature. After reaction completion, volatile components, including any alkylene glycol generated during the reaction, may be stripped off. Preferably, the alkenyl or alkyl succinic anhydride may be added directly to the reaction mixture. When a diluent is employed, it is preferably inert to the reactants and products formed and is generally used in an amount sufficient to insure efficient stirring.

The reaction is generally complete in about 0.5 to 10 hours.

The polyamine-cyclic carbonate adduct is then contacted with an alkenyl or alkyl succinic anhydride. The reaction is conducted at a temperature sufficient to cause reaction of the adduct with the alkenyl or alkyl succinic anhydride. The reaction temperature may be the same or different as in step (1). In particular, reaction temperatures of from about 0° C. to about 250° C. are preferred with temperatures of from about 100° C. to 200° C. being most preferred.

The reaction may be conducted neat—that is, the alkenyl or alkyl succinic anhydride may be combined with the polyamine-cyclic carbonate adduct in the proper ratio, and then stirred at the reaction temperature.

Alternatively, the reaction may be conducted in a diluent either the same or different from employed in step (1). For example, the reactants may be combined in a solvent such as toluene, xylene, oil or the like, and then stirred at the reaction temperature. In a preferred embodiment, the alkenyl or alkyl succinic anhydride is added directly to reaction system employed to prepare the cyclic carbonate-polyamine adduct. After reaction completion, volatile components may be stripped off. When a diluent is employed, it is preferably inert to the reactants and products formed and is generally used in an amount sufficient to insure efficient stirring.

Water may be present in the product, particularly when a low ratio of cyclic carbonate to the basic nitrogen of the polyamine is employed to prepare the cyclic carbonate-polyamine adduct. The water or other volatile components may be removed from the reaction system during the course of the reaction via azeotroping, distillation or nitrogen blowing. Likewise, water or any other volatile components may be removed after reaction completion. For example, the reaction product may be treated by passing a nitrogen stream over it or it may be stripped at elevated temperatures (100° C. to 250° C.) and reduced pressures to remove water or any other volatile components.

Another embodiment of the above process is a continuous flow system in which the cyclic carbonate and polyamine are added at the front end of the flow while the alkenyl or alkyl succinic anhydride is added further downstream in the system.

Mole ratios of the cyclic carbonate to the basic amine nitrogen of the polyamine employed in this invention are generally in the range of from about 0.1:1 to about 10:1, although preferably from about 0.5:1 to about 5:1.

Mole ratios of the alkenyl or alkyl succinic anhydride to the cyclic carbonate-polyamine adduct are generally in the range of from about 0.5:1 to about 5:1, preferably from about 0.5:1 to 2:1, most preferably from about 1:1 to 2:1.

The reaction is generally complete from within 0.5 to 10 hours.

A. ALKENYL OR ALKYL SUCCINIC ANHYDRIDES

The preparation of the alkenyl-substituted succinic anhydride by reaction with a polyolefin and maleic anhydride has been described, e.g., U.S. Pat. Nos. 3,018,250 and 3,024,195. Such methods include the thermal reaction of the polyolefin with maleic anhydride and the reaction of a halogenated polyolefin, such as a chlorinated polyolefin, with maleic anhydride. Reduction of the alkenyl-substituted succinic anhydride yields the corresponding alkyl derivative. Alternatively, the alkenyl substituted succinic anhydride may be prepared as described in U.S. Pat. Nos. 4,388,471 and 4,450,281 which are totally incorporated herein by reference.

Polyolefin polymers for reaction with the maleic anhydride are polymers comprising a major amount of $C_2$ to $C_5$ mono-olefin, e.g., ethylene, propylene, butylene, isobutylene and pentene. The polymers can be homopolymers such as polyisobutylene as well as copolymers of 2 or more such olefins such as copolymers of: ethylene and propylene, butylene, and isobutylene, etc. Other copolymers include those in which a minor amount of the copolymer monomers, e.g., 1 to 20 mole percent is a $C_4$ to $C_8$ nonconjugated diolefin, e.g., a copolymer of isobutylene and butadiene or a copolymer of ethylene, propylene and 1,4-hexadiene, etc.

The polyolefin polymer usually contains from about 10 to 300 carbon atoms, although preferably 10 to 200 carbon atoms and most preferably 20 to 100 carbon atoms.

A particularly preferred class of olefin polymers comprises the polybutenes, which are prepared by polymerization of one or more of 1-butene, 2-butene and isobutene. Especially desirable are polybutenes containing a substantial proportion of units derived from isobutene. The polybutene may contain minor amounts of butadiene which may or may not be incorporated in the polymer. Most often the isobutene units constitute 80%, preferably at least 90%, of the units in the polymer. These polybutenes are readily available commercial materials well known to those skilled in the art. Disclosures thereof will be found, for example, in U.S. Pat. Nos. 3,215,707; 3,231,587; 3,515,669; and 3,579,450, as well as U.S. Pat. No. 3,912,764. The above are incorporated by reference for their disclosures of suitable polybutenes.

In addition to the reaction of a polyolefin with maleic anhydride, many other alkylating hydrocarbons may likewise be used with maleic anhydride to produce alkenyl succinic anhydride. Other suitable alkylating hydrocarbons include cyclic, linear, branched and internal or alpha olefins with molecular weights in the range 100–4,500 or more with molecular weights in the range of 200–2,000 being more preferred. For example, alpha olefins obtained from the thermal cracking of paraffin wax. Generally, these olefins range from 5–20 carbon atoms in length. Another source of alpha olefins is the ethylene growth process which gives even number carbon olefins. Another source of olefins is by the dimerization of alpha olefins over an appropriate catalyst such as the well known Ziegler catalyst. Internal olefins are easily obtained by the isomerization of alpha olefins over a suitable catalyst such as silica.

Alkenyl or alkyl substituted succinic acid may be employed in this invention and is considered the equivalent of alkenyl or alkyl substituted succinic anhydride.

B. POLYAMINE

The polyamine employed to prepare the additives of this invention is preferably derived from a polyamine having from 1 to about 12 amine nitrogen atoms and from 2 to about 40 carbon atoms. The polyamine is reacted with a cyclic carbonate to produce the polyamine-cyclic carbonate adducts employed as intermediates in this invention. The polyamine so selected contains at least one basic amine nitrogen. Since the reaction of the polyamine with the carbonates employed in this invention is believed to proceed through a secondary or primary amine, at least one of the basic amine atoms of the polyamine must either be a primary amine or a secondary amine. Accordingly, in those instances in which the polyamine contains only one basic amine, that amine must either be a primary amine or a secondary amine. The polyamine preferably has a carbon-to-nitrogen ratio of from about 1:1 to about 10:1.

The polyamine may be substituted with one or more substituents selected from (A) hydrogen, (B) hydrocarbyl groups of from 1 to about 10 carbon atoms, (C) acyl groups of from 2 to about 10 carbon atoms, and (D) keto, hydroxy, nitro, cyano, lower alkyl and lower alkoxy derivatives of (B) and (C). "Lower", as used in terms like lower alkyl or lower alkoxy, means a group containing from 1 to about 6 carbon atoms. At least one of the substituents on one of the amines of the polyamine is hydrogen, e.g., at least one of the basic nitrogen atoms of the polyamine is a primary or secondary amino nitrogen atom.

Hydrocarbyl, as used in describing the polyamine components of this invention, denotes an organic radical composed of carbon and hydrogen which may be aliphatic, alicyclic, aromatic or combinations thereof, e.g., aralkyl. Preferably, the hydrocarbyl group will be relatively free of aliphatic unsaturation, i.e., ethylenic and acetylenic, particularly acetylenic unsaturation. The substituted polyamines of the present invention are generally, but not necessarily, N-substituted polyamines. Exemplary hydrocarbyl groups and substituted hydrocarbyl groups include alkyls such as methyl, ethyl, propyl, butyl, isobutyl, pentyl, hexyl, octyl, etc., alkenyls such as propenyl, isobutenyl, hexenyl, octenyl, etc., hydroxyalkyls, such as 2-hydroxyethyl, 3-hydroxypropyl, hydroxyisopropyl, 4-hydroxybutyl, etc., ketoalkyls, such as 2-ketopropyl, 6-ketooctyl, etc., alkoxy and lower alkenoxy alkyls, such as ethoxyethyl, ethoxypropyl, propoxyethyl, propoxypropyl, 2-(2-ethoxyethoxy)ethyl, 2-(2-(2-ethoxyethoxy)ethoxy)ethyl, 3,6,9,12-tetraoxatetradecyl, 2-(2-ethoxyethoxy)hexyl, etc. The acyl groups of the aforementioned (C) substituents are such as propionyl, acetyl, etc. The more preferred substituents are hydrogen, $C_1$–$C_6$ alkyls and $C_1$–$C_6$ hydroxyalkyls.

In a substituted polyamine the substituents are found at any atom capable of receiving them. The substituted atoms, e.g., substituted nitrogen atoms, are generally geometrically inequivalent, and consequently the substituted amines finding use in the present invention can be mixtures of mono- and polysubstituted polyamines with substituent groups situated at equivalent and/or inequivalent atoms.

The more preferred polyamine finding use within the scope of the present invention is a polyalkylene polyamine, including alkylene diamine, and including substituted polyamines, e.g., alkyl and hydroxyalkyl-substituted polyalkylene polyamine. Preferably, the alkylene group contains from 2 to 6 carbon atoms, there being preferably from 2 to 3 carbon atoms between the nitrogen atoms. Such groups are exemplified by ethylene, 1,2-propylene, 2,2-dimethyl-propylene, trimethylene, 1,3,2-hydroxypropylene, etc. Examples of such polyamines include ethylene diamine, diethylene triamine, di(trimethylene)triamine, dipropylene triamine, triethylene tetramine, tripropylene tetramine, tetraethylene pentamine, and pentaethylene hexamine. Such amines encompass isomers such as branched-chain polyamines and the previously mentioned substituted polyamines, including hydroxy- and hydrocarbyl-substituted polyamines. Among the polyalkylene polyamines, those containing 2–12 amine nitrogen atoms and 2–24 carbon atoms are especially preferred, and the $C_2$–$C_5$ alkylene polyamines are most preferred, in particular, the lower polyalkylene polyamines, e.g., ethylene diamine, dipropylene triamine, etc.

The polyamine component also may contain heterocyclic polyamines, heterocyclic substituted amines and substituted heterocyclic compounds, wherein the heterocycle comprises one or more 5–6 membered rings containing oxygen and/or nitrogen. Such heterocycles may be saturated or unsaturated and substituted with groups selected from the aforementioned (A), (B), (C) and (D). The heterocycles are exemplified by piperazines, such as 2-methylpiperazine, N-(2-hydroxyethyl)-piperazine, 1,2-bis-(N-piperazinyl)ethane, and N,N'-bis(N-piperazinyl)piperazine, 2-methylimidazoline, 3-aminopiperidine, 2-aminopyridine, 2-(3-aminoethyl)-3-pyrroline, 3-aminopyrrolidine, N-(3-aminopropyl)-mortpholine, etc. Among the heterocyclic compounds, the piperazines are preferred.

Typical polyamines that can be used to form the compounds of this invention include the following: ethylene diamine, 1,2-propylene diamine, 1,3-propylene diamine, diethylene triamine, triethylene tetramine, hexamethylene diamine, tetraethylene pentamine, methylaminopropylene diamine, N-(betaaminoethyl)piperazine, N-(beta-aminoethyl)piperidine, N-(beta-aminoethyl)morpholine, N,N'-di(betaaminoethyl)piperazine, N,N'-di(beta-aminoethyl)imidazolidone-2, N-(beta-cyanoethyl)ethane-1,2-diamine, 1,3,6,9-tetraaminooctadecane, 1,3,6-triamino-9-oxadecane, N-(beta-aminoethyl)diethanolamine, N'-acetyl-N'-methyl-N-(beta-aminoethyl)-ethane1,2-diamine, N-methyl-1,2-propanediamine, N-(betanitroethyl)-1,3-propane diamine, 5-(beta-aminoethyl)-1,3,5-dioxazine, 2-(2-aminoethylamino)-ethanol,2-[2-(2-aminoethylamino)ethylamino]-ethanol.

Another group of suitable polyamines are the propyleneamines, (bisaminopropylethylenediamines). Propyleneamines are prepared by the reaction of acrylonitrile with an ethyleneamine, for example, an ethyleneamine having the formula $H_2N(CH_2CH_2NH)_ZH$ wherein Z is an integer from 1 to 5, followed by hydrogenation of the resultant intermediate. Thus, the product prepared from ethylene diamine and acrylonitrile would be $H_2N(CH_2)_3NH(CH_2)_2NH(CH_2)_3NH_2$.

In many instances the polyamine used as a reactant in the production of the additives of the present invention is not a single compound but a mixture in which one or several compounds predominate with the average composition indicated. For example, tetraethylene pentamine prepared by the polymerization of aziridine or the reaction of dichloroethylene and ammonia will have both lower and higher amine members, e.g., triethylene tetramine, substituted piperazines and pentaethylene hexamine, but the composition will be largely tetraethylene pentamine and the empirical formula of the total amine composition will closely approximate that of tetraethylene pentamine. Finally, in preparing the additives for use in this invention, where the various nitrogen atoms of the polyamine are not geometrically equivalent, several substitutional isomers are possible and are encompassed within the final product. Methods of preparation of polyamines and their reactions are detailed in Sidgewick's "The Organic Chemistry of Nitrogen", Clarendon Press, Oxford, 1966; Noller's "Chemistry of Organic Compounds", Saunders, Philadelphia, 2nd Ed., 1957; and Kirk-Othmer's "Encyclopedia of Chemical Technology", 2nd Ed., especially Volumes 2, pp. 99–116.

C. CARBONATES

Cyclic carbonates employed in this invention react with a basic primary or secondary amine to form either a corresponding carbamate or a hydroxyalkylamine derivative. Suitable cyclic carbonates include:

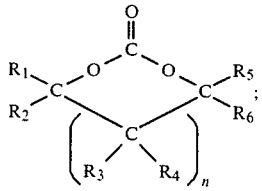
(1)

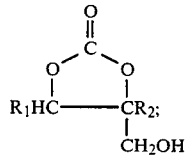
(2)

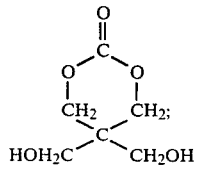
(3)

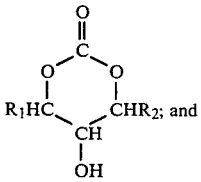
(4)

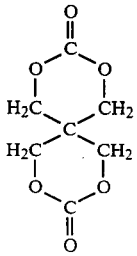
(5)

wherein $R_1$, $R_2$, $R_3$, $R_4$, $R_5$ and $R_6$ are independently selected from hydrogen or lower alkyl of 1 to 2 carbon atoms; and n is an integer from 0 to 1.

Preferred cyclic carbonates for use in this invention are those of formula 1 above. Preferred $R_1$, $R_2$, $R_3$, $R_4$, $R_5$ and $R_6$ are either hydrogen or methyl. Most preferably $R_1$, $R_2$, $R_3$, $R_4$, $R_5$ and $R_6$ are hydrogen, when n is one. $R_6$ is most preferably hydrogen or methyl while $R_1$, $R_2$, and $R_5$ are hydrogen when n is zero.

The following are examples of suitable cyclic carbonates for use in this invention: 1,3-dioxolan-2-one(ethylene carbonate); 4-methyl-1,3-dioxolan-2-one(propylene carbonate); 4-hydroxymethyl-1,3-dioxolan-2-one; 4,5-dimethyl-1,3-dioxolan-2-one; 4-ethyl-1,3-dioxolan-2-one; 4,4-dimethyl-1,3-dioxolan-2-one; 4-methyl-5-ethyl-1,3-dioxolan-2-one; 4,5-diethyl-1,3-dioxolan-2-one; 4,4-dimethyl-1,3-dioxan-2-one; 5,5-dimethyl-1,3-dioxan-2-one; 5,5-dihydroxymethyl-1,3-dioxan-2-one; 5-methyl-1,3-dioxan-2-one; 4-methyl-1,3-dioxan-2-one; 5-hydroxy-1,3-dioxan-2-one; 5,5-diethyl-1,3-dioxan-2-one; 5-methyl-5-propyl-1,3-dioxan-2-one; 4,6-dimethyl-1,3-dioxan-2-one; 4,4,6-trimethyl-1,3-dioxan-2-one and spiro[1,3-oxa-2-cyclohexanone-5,5'-1',3'-oxa-2'-cyclohexanone].

Several of these cyclic carbonates are commercially available such as 1,3-dioxolan-2-one or 4-methyl-1,3-dioxolan-2-one. Cyclic carbonates may be readily prepared by known reactions. For example, reaction of phosgene with a suitable alpha alkane diol or an alkan-1,3-diol yields a carbonate for use within the scope of this invention (see U.S. Pat. No. 4,115,206).

Likewise, the cyclic carbonates useful for this invention may be prepared by transesterification of a suitable alpha alkane diol or an alkan-1,3-diol with, e.g., diethyl carbonate under transesterification conditions. See, for instance, U.S. Pat. Nos. 4,384,115 and 4,423,205 which are incorporated herein by reference for their teaching of the preparation of cyclic carbonates.

As used herein, the term "alpha alkane diol" means an alkane group having two hydroxyl substituents wherein the hydroxyl substituents are on adjacent carbons to each other. Examples of alpha alkane diols include 1,2-propanediol, 2,3-butanediol and the like.

The term "alkan-1,3-diol" means an alkane group having two hydroxyl substituents wherein the hydroxyl substituents are beta substituted. That is, there is a methylene or a substituted methylene moiety between the hydroxyl substituted carbons. Examples of alkan-1,3-diols include propan-1,3-diol, pentan-2,4-diol and the like.

As used herein, the term "spiro[1,3-oxa-2-cyclohexanone-5,5'-1',3'-oxa-2'cyclohexanone] means the group

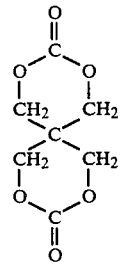

As used herein, the term "molar charge of cyclic carbonate to the basic nitrogen of a polyamine" means that the molar charge of cyclic carbonate employed in the reaction is based upon the theoretical number of basic nitrogens (i.e., nitrogens titratable by a strong acid) contained in the polyamine. Thus, triethylene tetraamine (TETA) will theoretically contain 4 basic nitrogens. Accordingly, a molar charge of 1 would require that a mole of cyclic carbonate be added for each basic nitrogen or in this case 4 moles of cyclic carbonate for each mole of TETA.

For the purpose of this invention, the molecular weight of the cyclic carbonate-polyamine adduct is estimated by taking the molecular weight of the polyamine and adding thereto the molecular weight of the cyclic carbonate multiplied by the number of equivalents employed. Accordingly, if TETA (mw=146) is reacted with two equivalents of ethylene carbonate (mw=88), the estimated molecular weight of the adduct would be 322 (146+2(88)).

The alpha alkane diols, used to prepare the 1,3-dioxolan-2-ones employed in this invention, are either commercially available or may be prepared from the corresponding olefin by methods known in the art. For example, the olefin may first react with a peracid, such as peroxyacetic acid or hydrogen perioxide plus formic acid to form the corresponding epoxide which is readily hydrolyzed under acid or base catalysis to the alpha alkane diol. In another process, the olefin is first halogenated to a dihalo derivative and subsequently hydrolyzed to an alpha alkane diol by reaction first with sodium acetate and then with sodium hydroxide. The olefins so employed are known in the art.

The alkan-1,3-diols, used to prepare the 1,3-dioxan-2-ones employed in this invention, are either commercially available or may be prepared by standard techniques, e.g., derivatizing malonic acid.

4-Hydroxymethyl 1,3-dioxolan-2-one derivatives and 5-hydroxy-1,3-dioxan-2-one derivatives may be prepared by employing glycerol or substituted glycerol in the process of U.S. Pat. No. 4,115,206. The mixture so prepared may be separated, if desired, by conventional techniques. Preferably the mixture is used as is.

5,5-Dihydroxymethyl-1,3-dioxan-2-one may be prepared by reacting an equivalent of pentaerythritol with an equivalent of either phosgene or diethylcarbonate (or the like) under transesterification conditions.

Spiro[1,3-oxa-2-cyclohexanone-5,5'-1',3'-oxa-2'-cyclohexanone] may be prepared by reacting an equivalent of pentaerythritol with two equivalents of either phosgene or diethylcarbonate (or the like) under transesterification conditions.

D. POLYAMINE-CARBONATE ADDUCTS

Cyclic carbonates of Formula I are used to illustrate the reaction of the carbonate with the succinimide. It is to be understood that the other cyclic carbonates employed in this invention react similarly. Cyclic carbonates initially react with the primary and secondary amines of a polyamine to form two types of compounds. In the first instance, strong bases, including unhindered amines such as primary amines and some secondary amines, react with an equivalent of cyclic carbonate to produce a carbamic ester as shown in reaction (1a) below:

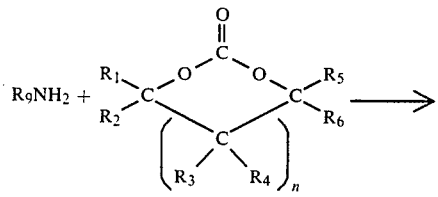

(1a)

IV I $R_9NHC(o)OCR_1R_2(CR_3R_4)_nCR_5R_6OH$

V wherein $R_1$, $R_2$, $R_3$, $R_4$, $R_5$, $R_6$ and n are as defined above and $R_9$ is the remainder of the polyamine. In this reaction, the amine nitrogen has been rendered nonbasic by formation of the carbamate, V.

It is contemplated that under high temperature or over prolong reaction conditions carbamate, V, may further react either inter- or intra-molecularly with a primary or secondary amine to form an urea linkage with the concomitant elimination of a glycol as shown in (1b) below:

$$R_9NHC(o)OCR_1R_2(CR_3R_4)_nCR_3R_6OH + R_{11}R_{12}NH \longrightarrow \quad (1b)$$

V $$R_9NHC(O)NR_{11}R_{12} + HOCR_1R_2(CR_3R_4)_nCR_5R_6OH$$

XIII XIV wherein $R_{11}$ and $R_{12}$ are the remainder of a polyamine moiety and $R_1$, $R_2$, $R_3$, $R_4$, $R_5$, $R_6$, $R_9$ and n are as defined above. The urea linkage formed may either be cyclic or acyclic depending upon whether the reaction proceeds via an intra- or inter-molecular route, respectively. It is contemplated that products containing some urea linkages are more likely produced by heating the system at or greater than 160° C., and preferably greater than 190° C.

In the second instance, hindered bases, such as hindered secondary amines, may react with an equivalent of the same cyclic carbonate to form a hydroxyalkyleneamine linkage with the concomitant elimination of $CO_2$ as shown below in reaction (2):

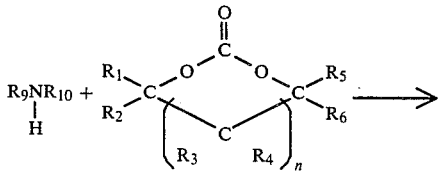

(2)

VI $R_9R_{10}NCR_1R_2(CR_3R_4)_nCR_5R_6OH + CO_2$

VII wherein $R_1$, $R_2$, $R_3$, $R_4$, $R_5$, $R_6$, $R_9$ and n are as defined above and $R_{10}$ is an alkyl or alkylene linking group which hinders the amine. Unlike the carbamate products of reaction (1a), or the urea products of reaction (1b) the hydroxyalkyleneamine products of reaction (2) retain their basicity.

In theory, if only primary and secondary amines are employed in the polyamine moiety, a determination of whether the carbonate addition follows reaction (1a) or reaction (2) could be made by monitoring the AV (alkalinity value or alkalinity number—refers to the amount of base as milligrams of KOH in 1 gram of a sample) of the product. Accordingly, if the reaction proceeded via reaction (1a), a reaction product prepared by reacting an equivalent of carbonate for each basic nitrogen should yield an AV of zero even if any part of reaction (1a) subsequently proceeded via reaction (1b) to yield urea type products. That is to say that all the basic amines in the polyamine moiety have been converted to nonbasic carbamates and possibly then to nonbasic ureas.

However, as previously noted, alkylene polyamines such as triethylene tetraamine and tetraethylene pentamine, contain tertiary amines (piperazines, etc.) which may account for as much as 30% of the basic nitrogen content. Although Applicant does not want to be limited to any theory, it is believed that these tertiary amines, although basic, are not reactive with the carbonate. Accordingly, even if the reaction proceeded entirely by reaction (1a) above, an AV of approximately 30% of the original AV may be retained in the final product. Nevertheless, a large drop in the AV of the product is significant evidence that a substantial portion of the reaction product contains carbamic esters.

In fact, the addition of approximately one equivalent of ethylene carbonate for each basic nitrogen of the polyamine appreciably lowers the AV for TETA and for tetramethylenepentaamine (TEPA). This indicates that a substantial portion of the first equivalent of ethylene carbonate is adding to the nitrogen via reaction (1a) yielding carbamic esters.

On the other hand, the addition of a second equivalent of ethylene carbonate in these reactions does not result in appreciably further lowering of the AV. This suggests that the additional carbonate is reacting via reaction (2) above or with the hydroxyl group of the hydroxylalkylene amine groups as shown in reaction 3(b) below or are reacting with the hydroxyl group of the hydroxy alkylene carbamates as shown in reaction 3(a) below:

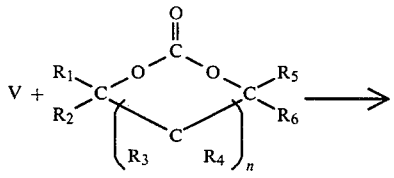

(3a)

I $R_9HNC(O)OCR_1R_2(CR_3R_4)_nCR_5R_6OCR_1R_2(CR_3R_4)_nCR_5R_6OH + CO_2$

IX $$VII + I \longrightarrow R_9R_{10}N[CR_1R_2(CR_3R_4)_nCR_5R_6O]_2H \quad 3(b)$$

XI wherein $R_1$, $R_2$, $R_3$, $R_4$, $R_5$, $R_6$, $R_9$ and n are as defined above.

Repeating the process of reaction 3(b) above by the addition of increasing amounts of carbonate produces a hydroxyalkylenepoly(oxyalkylene)amine derivative of Formula XII below:

$$R_9R_{10}N[CR_1R_2(CR_3R_4O)_nCR_5R_6]_yH$$
XII wherein $R_1$, $R_2$, $R_3$, $R_4$, $R_8$, $R_9$, $R_{10}$ and n are as defined above and y is an integer from 3 to 10.

The process of reaction 3(a) allows for additional carbonate to add to the hydroxyl group of product IX as shown in reaction 3(c) below:

$$IX + I \longrightarrow \qquad 3(c)$$

$$R_9NHC(=O)[OCR_1R_2(CR_3R_4)_nCR_5R_6]_2OCR_1R_2(CR_3R_4)_nCR_5R_6OH + CO_2$$

wherein $R_1$, $R_2$, $R_3$, $R_4$, $R_5$, $R_6$ and $R_{10}$ are as defined above. As is apparent from the above reaction, the poly(oxyalkylene) portion of the carbamate can be repeated several times simply by addition of more carbonate.

It is also contemplated that reactions 3(a) and 3(b) above may also produce acyclic carbonate linkages with the terminal hydroxyl group. Likewise, if $R_9$ (or $R_{10}$) is hydrogen, then an additional hydroxyalkylene could add to the amino group with elimination of $CO_2$ from the carbonate.

Accordingly, it is expected that the reaction of a cyclic carbonate with a polyamine will yield a mixture of products. When the CMR of the cyclic carbonate to the basic nitrogen of the polyamine is about 1 or less, it is anticipated that a large portion of the primary and secondary amines of the polyamine will have been converted to carbamic esters with some hydroxyalkyleneamine derivatives also being formed. As the CMR is raised above 1, poly(oxyalkylene)polymers of the carbamic esters and the hydroxyalkyleneamine derivatives are expected.

It is also expected that use of the spiro[1,3-oxa-2-cyclohexanone-5,5'-1',3'-oxa-2'-cyclohexanone] will yield products which would be both internally cyclized products and cross-linking between two polyamines.

In some instances, it may be desirable to increase the proportion of carbamic esters formed in these reactions. This may be accomplished by employing a polyamine with a large percentage of primary amine. Another method may be to employ alkyl-substituted (i.e., one or more of $R_1$, $R_2$, $R_3$, $R_4$, $R_5$, or $R_6$ is alkyl) or hydroxyalkyl substituted carbonates.

E. COMPLEXES FORMED BY CONTACTING THE CYCLIC CARBONATE-POLYAMINE ADDUCT WITH AN ALKENYL OR ALKYL SUCCINIC ANHYDRIDE

Although Applicant does not wish to be limited to any theory, it is believed that succinimides are more thermodynamically stable than succinamides which themselves are believed to be more thermodynamically stable than succinates. Accordingly, the product expected from treating the cyclic carbonate-polyamine adduct depends in large part on the nature of the cyclic carbonate-polyamine adducts employed. For example, if the adduct contains primary amines, the product obtained by combining the adduct with an alkenyl or alkyl succinic anhydride is expected to be a succinimide. Likewise, if the adduct contains no primary amines but contains secondary amines, the product obtained by combining the adduct with an alkenyl or alkyl succinic anhydride is expected to be a succinamide. Lastly, if the adduct contains no primary or secondary amines, the alkenyl or alkyl succinic anhydride is believed to react with a hydroxy group of the adduct to form a succinate ester.

Adducts containing primary amines may be produced by using low charge mole ratios (0.1 to 0.4) of cyclic carbonate to the basic amine nitrogen while employing a polyamine with a high primary amine content. Adducts containing only secondary amines are favored by employing an intermediate CMR (0.4 to 0.8) while employing a polyamine with a high secondary amine content. Lastly, adducts containing neither primary nor secondary amines are favored by employing a large CMR of cyclic carbonate (greater than 1). It is understood that the ratios employed above are only estimates and that higher or lower ratios may be employed by modifying the nature of the polyamine.

In any event, the adducts obtained by combining a polyamine with a cyclic carbonate at either a low, intermediate or high CMR will react with an alkenyl or alkyl succinic anhydride to form an additive possessing dispersancy or detergency properties in lubricating oils or fuels provided that the adducts contain at least one primary or secondary amine or a hydroxyl group.

These additives can be posttreated with boric acid or a similar boron compound to form borated dispersants having utility within the scope of this invention. In addition to boric acid (boron acid), examples of suitable boron compounds include boron oxides, boron halides and esters of boric acid. Generally from about 0.1 equivalents to 10 equivalents of boron compound to the modified succinimide may be employed.

The modified alkenyl or alkyl succinimides of this invention are useful as detergent and dispersant additives when employed in lubricating oils. When employed in this manner, the modified alkenyl or alkyl succinimide additive is usually present in from 0.2 to 10 percent by weight to the total composition and preferably at about 0.5 to 5 percent by weight. The lubricating oil used with the additive compositions of this invention may be mineral oil or synthetic oils of lubricating viscosity and preferably suitable for use in the crankcase of an internal combustion engine. Crankcase lubricating oils ordinarily have a viscosity of about 1300 CSt 0° F. to 22.7 CSt at 210° F. (99° C.). The lubricating oils may be derived from synthetic or natural sources. Mineral oil for use as the base oil in this invention includes paraffinic, naphthenic and other oils that are ordinarily used in lubricating oil compositions. Synthetic oils include both hydrocarbon synthetic oils and synthetic esters. Useful synthetic hydrocarbon oils include liquid polymers of alpha olefins having the proper viscosity. Especially useful are the hydrogenated liquid oligomers of $C_6$ to $C_{12}$ alpha olefins such as 1-decene trimer. Likewise, alkyl benzenes of proper viscosity such as didodecyl benzene, can be used. Useful synthetic esters include the esters of both monocarboxylic acid and polycarboxylic acids as well as monohydroxy alkanols and polyols. Typical examples are didodecyl adipate, pentaerythritol tetracaproate, di-2-ethylhexyl adipate, dilaurylsebacate and the like. Complex esters prepared from mixtures of mono and dicarboxylic acid and mono and dihydroxy alkanols can also be used.

Blends of hydrocarbon oils with synthetic oils are also useful. For example, blends of 10 to 25 weight percent hydrogenated 1-decene trimer with 75 to 90 weight percent 150 SUS (100° F.) mineral oil gives an excellent lubricating oil base.

Additive concentrates are also included within the scope of this invention. The concentrates of this invention usually include from about 90 to 10 weight percent of an oil of lubricating viscosity and from about 10 to 90 weight percent of the complex additive of this invention. Typically, the concentrates contain sufficient diluent to make them easy to handle during shipping and storage. Suitable diluents for the concentrates include any inert diluent, preferably an oil of lubricating viscosity, so that the concentrate may be readily mixed with lubricating oils to prepare lubricating oil compositions. Suitable lubricating oils which can be used as diluents typically have viscosities in the range from about 35 to about 500 Saybolt Universal Seconds (SUS) at 100° F. (38° C.), although an oil of lubricating viscosity may be used.

Other additives which may be present in the formulation include rust inhibitors, foam inhibitors, corrosion inhibitors, metal deactivators, pour point depressants, antioxidants, and a variety of other wellknown additives.

It is also contemplated the modified succinimides of this invention may be employed as dispersants and detergents in hydraulic fluids, marine crankcase lubricants and the like. When so employed, the modified succinimide is added at from about 0.1 to 10 percent by weight to the oil. Preferably, at from 0.5 to 5 weight percent.

When used in fuels, the proper concentration of the additive necessary in order to achieve the desired detergency is dependent upon a variety of factors including the type of fuel used, the presence of other detergents or dispersants or other additives, etc. Generally, however, and in the preferred embodiment, the range of concentration of the additive in the base fuel is 10 to 10,000 weight parts per million, preferably from 30 to 2,000 weight parts per million, and most preferably from 30 to 700 parts per million of the modified succinimide per part of base fuel. If other detergents are present, a lesser amount of the modified succinimide may be used.

The modified additives of this invention may be formulated as a fuel concentrate, using an inert stable oleophilic organic solvent boiling in the range of about 150° to 400° F. Preferably, an aliphatic or an aromatic hydrocarbon solvent is used, such as benzene, toluene, xylene or higher-boiling aromatics or aromatic thinners. Aliphatic alcohols of about 3 to 8 carbon atoms, such as isopropanol, isobutylcarbinol, n-butanol and the like, in combination with hydrocarbon solvents are also suitable for use with the fuel additive. In the fuel concentrate, the amount of the additive will be ordinarily at least 10 percent by weight and generally not exceed 70 percent by weight and preferably from 10 to 25 weight percent.

The following examples are offered to specifically illustrate this invention. These examples and illustrations are not to be construed in any way as limiting the scope of this invention.

EXAMPLES

Example 1

Add 2 g of triethylene tetraamine (with an AV of approximately 1180 mg KOH/g) to 20 ml of toluene in a 250 ml flask fitted with a stirrer, condensor and nitrogen inlet. Add 0.6 g ethylene carbonate to the mixture. Reflux the system for 2.5 hours under $N_2$. Strip the system to yield an ethylene carbonate-triethylene tetraamine adduct having an AV of approximately 670 mg KOH/g.

Example 2

Add 2 g of triethylene tetraamine (with an AV of approximately 1180 mg KOH/g) to 20 ml of toluene in a 250 ml flask fitted with a stirrer, condensor and nitrogen inlet. Add 1.21 g ethylene carbonate to the mixture. Reflux the system for 2.5 hours under $N_2$. Strip the system to yield an ethylene carbonate-triethylene tetraamine adduct having an AV of approximately 507 mg KOH/g.

Example 3

Add 2 g of triethylene tetraamine (with an AV of approximately 1180 mg KOH/g) to 20 ml of toluene in a 250 ml flask fitted with a stirrer, condensor and nitrogen inlet. Add 4.82 g ethylene carbonate to the mixture. Reflux the system for 2.5 hours under $N_2$. Strip the system to yield an ethylene carbonate-triethylene tetraamine adduct having an AV of approximately 250 mg KOH/g.

Example 4

Add 2 g of triethylene tetraamine (with an AV of approximately 1180 mg KOH/g) to 20 ml of toluene in a 250 ml flask fitted with a stirrer, condensor and nitrogen inlet. Add 27.6 g ethylene carbonate to the mixture. Reflux the system for 2.5 hours under $N_2$. Strip the system to yield an ethylene carbonate-triethylene tetraamine adduct having an AV of approximately 104 mg KOH/g.

Example 5

Add 56.7 g of tetraethylene pentaamine (with an AV of approximately 1050 mg KOH/g) to a 250 ml flask fitted with a stirrer, condensor and nitrogen inlet. Add 26.4 g ethylene carbonate to the system. Heat the system at 160° C. for 3 hours under $N_2$. Strip the system to yield an ethylene carbonate-triethylene tetraamine adduct having an AV of approximately 540 mg KOH/g.

Example 6

Add the product of Example 5 to a 250 ml flask equipped with a stirrer, Dean-Stark trap, condensor and nitrogen inlet. Heat the system at 195° C. for two hours while removing ethylene glycol (21.6 g) via the Dean-Stark trap. Remove any remaining ethylene glycol and other volatile components by stripping to yield an ethylene carbonate-tetraethylene pentaamine adduct having urea linkages (evidenced by an IR absorvance of 1610 $cm^{-1}$) and an approximate AV of 580 mg KOH/gm.

Example 7

Add 56.7 g of tetraethylene pentaamine (with an AV of approximately 1050 mg KOH/g) to a 250 ml flask fitted with a stirrer, condensor and nitrogen inlet. Add 26.4 g ethylene carbonate to the system. Heat the system at 160° C. for 3 hours under $N_2$. Strip the system to yield an ethylene carbonate-triethylene tetraamine adduct having an AV of approximately 410 mg KOH/g.

Example 8

Add the product of Example 7 to a 250 ml flask equipped with a stirrer, Dean-Stark trap, condensor and nitrogen inlet. Heat the system at 195° C. for two hours while removing ethylene glycol and other volatiles (total=15.8 g) via the Dean-Stark trap. Remove any remaining ethylene glycol and other volatile components by stripping to yield an ethylene carbonate-tetraethylene pentaamine adduct having urea linkages (evidenced by an IR absorbance of 1610 $cm^{-1}$) and an approximate AV of 340 mg KOH/gm.

Example 9

Add 37.8 g of tetraethylene pentaamine (with an AV of approximately 1050 mg KOH/g) to a 250 ml flask fitted with a stirrer, condensor and nitrogen inlet. Add 52.6 g ethylene carbonate to the system. Heat the system at 160° C. for 3 hours under $N_2$. Strip the system to yield an ethylene carbonate-triethylene tetraamine adduct having an AV of approximately 180 mg KOH/g.

Example 10

Add the product of Example 9 to a 250 ml flask equipped with a stirrer, Dean-Stark trap, condensor and nitrogen inlet. Heat the system at 195° C. for two hours while removing ethylene glycol and other volatiles via the Dean-Stark trap. Remove any remaining ethylene glycol and other volatile components by stripping to yield an ethylene carbonate-tetraethylene pentaamine adduct having urea linkages (evidenced by an IR absorbance of 1610 $cm^{-1}$) and an approximate AV of 370 mg KOH/gm.

Example 11

Add 94.5 g of tetraethylene pentaamine (with an AV of approximately 1050 mg KOH/g) to a 500 ml flask equipped with a stirrer, condensor and nitrogen inlet. Add 220 g of ethylene carbonate to the system. Heat the system at 160° C. for 3 hours under $N_2$. Strip the system to yield an ethylene carbonate-tetraethylene pentaamine adduct having an AV of approximately 180 mg KOH/gm.

Example 12

Add the product of Example 11 to a 500 ml flask equipped with a stirrer, Dean-Stark trap, condenser and nitrogen inlet. Heat the system at 195° C. for two hours while removing ethylene glycol and other volatiles via the Dean-Stark trap. Remove any remaining ethylene glycol and other volatile components by stripping to yield an ethylene carbonate-tetraethylene pentaamine adduct having urea linkages (evidenced by an IR absorbance of 1610 $cm^{-1}$) and an approximate AV of 273 mg KOH/gm.

Example 13

Add 9.5 g of tetraethylene pentaamine (having an AV of approximately 1050 mg KOH/g) to a 500 ml flask containing 8.8 g ethylene carbonate, 93 g of Citcon 100N oil and equipped with a stirrer and nitrogen inlet. Stir the system at room temperature for 2 hours. Add 116 g of a polyisobutenyl succinic anhydride composition (of average MW=950 and containing 65% actives in oil) to the system. Stir the system at room temperature for 24 hours to yield a product which is 30% actives in oil and having an AV of approximately 27 mg KOH/g.

Example 14

Add 37.9 g of tetraethylene pentaamine (having an AV of approximately 1050 mg KOH/g) to a one liter flask containing 52.8 g ethylene carbonate, 360 g of Citcon 350N oil and equipped with a stirrer, Dean-Stark trap, condensor and nitrogen inlet. Heat the system at 200° C. for one hour while removing ethylene glycol and other volatiles via the Dean-Stark trap. Cool the system to 160° C. and add 204 g of a polyisobutenyl succinic anhydride composition (of average MW=950 and containing 65% actives in oil) to the system. Stir for 2 hours at 160° to 170° C. Filter the hot product through Super-Cel (a diatomaceous earth filter aid) to give a clear amber oil containing 29% actives in oil and having an AV of approximately 17.5 mg KOH/g.

Example 15

Add 2 g of the product of Example 1 to a 100 ml flask containing 20 g of Citcon 100N oil and equipped with a stirrer and a nitrogen inlet. Add 10 g of a polyisobutenyl succinic anhydride composition (of average MW=950 and containing 65% actives in oil) to the system. Stir the system at room temperature for 24 hours to yield an additive of this invention in oil.

Example 16

Add 2 g of the product of Example 1 to a 100 ml flask containing 20 g of Citcon 350N oil and equipped with a stirrer, a Dean-Stark trap, condensor and nitrogen inlet. Heat the system at 200° C. for one hour while removing ethylene glycol and other volatiles via the Dean-Stark trap. Cool the system to 160° C. and add 10 g of a polyisobutenyl succinic anhydride composition (of average MW=540 and containing 65% actives in oil) to the system. Stir for 2 hours at 160° to 170° C. Filter the hot product through Super-Cel to yield an additive of this invention in oil.

Likewise, by the following procedures of Examples 15–16 and employing the appropriate concentration, adducts of Examples 2–12 may be substituted for the adduct of Example 1 to yield additives of this invention.

Example 17

Products of Examples 13 and 14 have been shown to possess dispersancy property in a comparison with a commercial dispersant.

Likewise, by following the procedures in the above examples, the following cyclic carbonates may be substituted for ethylene carbonate (1,3-dioxolan-2-one) to yield additives useful in this invention:

4-methyl-1,3-dioxolan-2-one; 4-hydroxymethyl-1,3-dioxolan-2-one; 4,5-dimethyl-1,3-dioxolan-2-one; 4-ethyl-1,3-dioxolan-2-one; 4-methyl-5-ethyl-1,3-dioxolan-2-one; 4,4-dimethyl-1,3-dioxolan-2-one; 4-n-propyl-1,3-dioxolan-2-one; 4,4-diethyl-1,3-dioxolan-2-one; 1,3-dioxolan-2-one; 4,4-dimethyl-1,3-dioxolan-2-one; 5,5-dimethyl-1,3-dioxolan-2-one; 5-methyl-1,3-dioxolan-2-one; 4-methyl-1,3-dioxolan-2-one; 5-hydroxymethyl-1,3-dioxolan-2-one; 5,5-diethyl-1,3-dioxolan-2-one; 5-methyl-5-n-propyl-1,3-dioxolan-2-one; 4,6-dimethyl-1,3-dioxolan-2-one; 4,4,6-trimethyl-1,3-dioxolan-2-one and spiro[1,3-oxa-2-cyclohexanon-5,5'-1',3'-oxa-2'-cyclohexanone].

Likewise, by following the procedures in the above examples, the following polyamines may be substituted for either tetraethylene pentaamine or triethylene tetraamine to yield additives useful in this invention:

ethylene diamine, 1,2-propylene diamine, 1,3-propylene diamine, diethylene triamine, triethylene tetramine, hexamethylene diamine, tetraethylene pentaamine, methylaminopropylene diamine, N-(betaaminoethyl)piperazine, N-(betaaminoethyl)piperidine, N-(betaaminoethyl)morpholine, N,N'-di(betaaminoethyl)piperazine, N,N'-di(betaaminoethyl)imidazolidone-2, N-(beta-cyanoethyl)ethane-1,2-diamine, 1,3,6,9-tetraaminooctadecane, 1,3,6-triamino-9-oxadecane, N-(beta-aminoethyl)diethanolamine, N'-acetyl-N-methyl-N-(betaaminoethyl)-ethane1,2-diamine, N-methyl-1,2-propanediamine, N-(betanitroethyl)-1,3-propane diamine, 5-beta-aminoethyl)-1,3,5-dioxazine, 2-(2-aminoethylamino)-ethanol,2-[2-[2-aminoethylamino]ethylaminio]-ethanol.

What is claimed is:

1. A fuel composition comprising a hydrocarbon boiling in the gasoline or diesel range and from 10 to 10,000 parts per million of a product prepared by the process which comprises (a) first reacting a polyamine with a cyclic carbonate at a temperature sufficient to cause reaction wherein the molar charge of said cyclic carbonate to the basic amine nitrogen of said polyamine is from about 0.1:1 to about 10:1; (b) contacting at a temperature sufficient to cause reaction the product of (a) above with an alkenyl or alkyl succinic anhydride wherein the molar charge of said alkenyl or alkyl succinic anhydride to said product of (a) above is from about 0.5:1 to about 5:1.

2. The fuel composition of claim 1 wherein the product of step (a) is further reacted by heating the adduct so produced at a temperature greater than 160° C. and for a time sufficient to effect elimination of alkylene glycol.

3. The fuel composition of claim 2 wherein during step (b) the alkylene glycol is removed from the reaction system prior to reaction with an alkenyl or alkyl succinic anhydride.

4. The fuel composition of claim 1 wherein the alkenyl or alkyl group of the alkenyl or alkyl succinic anhydride contains from 10 to 300 carbon atoms.

5. The fuel composition of claim 4 wherein the cyclic carbonate is selected from the group consisting of:

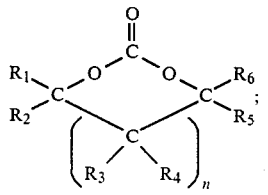

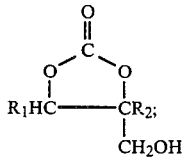

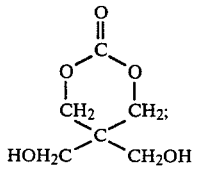

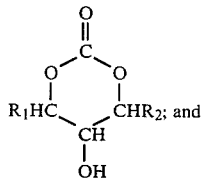

-continued

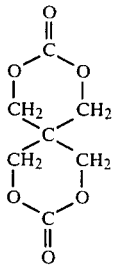

wherein $R_1$, $R_2$, $R_3$, $R_4$, $R_5$ and $R_6$ are independently selected from hydrogen or alkyl of from 1 to 2 carbon atoms; and n is an integer from 0 to 1.

6. The fuel composition of claim 5 wherein the cyclic carbonate is

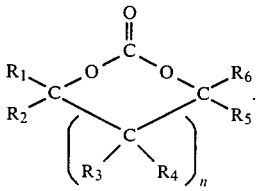

7. The fuel composition of claim 6 wherein n is zero and $R_1$, $R_2$, $R_5$ are hydrogen and $R_6$ is hydrogen or methyl.

8. The fuel composition of claim 7 wherein the cyclic carbonate is ethylene carbonate.

9. The fuel composition of claim 4 wherein the polyamine is a polyalkylene polyamine of from 2 to 12 amine nitrogen atoms and from 2 to 40 carbon atoms.

10. The fuel composition of claim 9 wherein the polyamine is selected from the group consisting of ethylene diamine; diethylene triamine; triethylene tetraamine; tetraethylene pentaamine; and pentaethylene hexaamine.

11. The fuel composition of claim 4 wherein the reaction is conducted at from 0° to 250° C.

12. A fuel composition comprising a hydrocarbon boiling in the gasoline or diesel range and from 30 to 2000 parts per million of a product prepared by the process which comprises (a) first reacting a polyamine with a cyclic carbonate at a temperature sufficient to cause reaction wherein the molar charge of said cyclic carbonate to the basic amine nitrogen of said polyamine is from about 0.1:1 to about 10:1; (b) contacting at a temperature sufficient to cause reaction the product of (a) above with an alkenyl or alkyl succinic anhydride wherein the molar charge of said alkenyl or alkyl succinic anhydride to said product of (a) above is from about 0.5:1 to about 5:1.

13. The fuel composition of claim 12 wherein the alkenyl or alkyl group of the alkenyl or alkyl succinic anhydride contains from 10 to 300 carbon atoms.

14. The fuel composition of claim 13 wherein the cyclic carbonate is selected from the group consisting of:

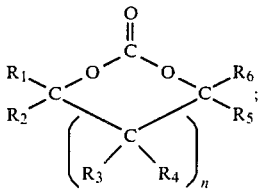

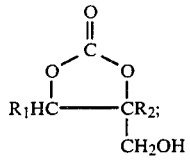

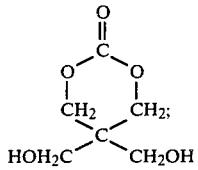

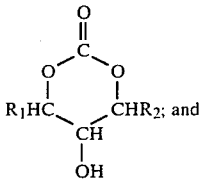

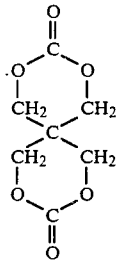

wherein $R_1$, $R_2$, $R_3$, $R_4$, $R_5$ and $R_6$ are independently selected from hydrogen or alkyl of from 1 to 2 carbon atoms; and n is an integer from 0 to 1.

15. A fuel concentrate comprising 30 to 90 weight percent of an inert stable oleophilic organic solvent and from 10 to 70 weight percent of a product prepared by the process which comprises (a) first reacting a polyamine with a cyclic carbonate at a temperature sufficient to cause reaction wherein the molar charge of said cyclic carbonate to the basic amine nitrogen of said polyamine is from about 0.1:1 to about 10:1; (b) contacting at a temperature sufficient to cause reaction the product of (a) above with an alkenyl or alkyl succinic anhydride wherein the molar charge of said alkenyl or alkyl succinic anhydride to said product of (a) above is from about 0.5:1 to about 5:1.

16. The fuel concentrate of claim 15 wherein the alkenyl or alkyl group of the alkenyl or alkyl succinic anhydride contains 10 to 300 carbon atoms.

17. The fuel concentrate of claim 16 wherein the cyclic carbonate is selected from the group consisting of:

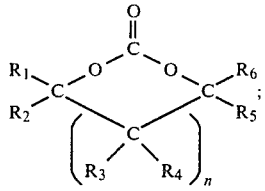

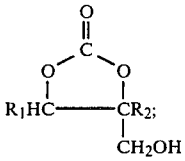

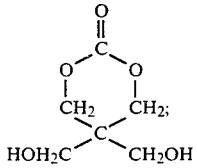

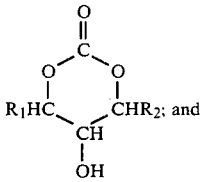

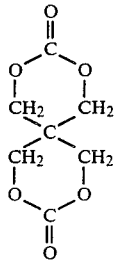

wherein $R_1$, $R_2$, $R_3$, $R_4$, $R_5$ and $R_6$ are independently selected from hydrogen or alkyl of from 1 to 2 carbon atoms; and n is an integer from 0 to 1.

18. The fuel concentrate of claim 17 wherein the polyamine is a polyalkylene polyamine of from 2 to 12 amine nitrogen atoms and from 2 to 40 carbon atoms.

19. The fuel concentrate of claim 18 wherein the polyamine is selected from the group consisting of ethylene diamine; diethylene triamine; triethylene tetraamine; tetraethylene pentaamine; and pentaethylene hexaamine.

* * * * *